US012117260B1

(12) United States Patent
Yang

(10) Patent No.: US 12,117,260 B1
(45) Date of Patent: Oct. 15, 2024

(54) CONCEALED INTAKE STRUCTURE OF A PAINTBALL GUN

(71) Applicant: Shu Yi Yang, Taichung (TW)

(72) Inventor: Shu Yi Yang, Taichung (TW)

( * ) Notice: Subject to any disclaimer, the term of this patent is extended or adjusted under 35 U.S.C. 154(b) by 30 days.

(21) Appl. No.: 18/301,662

(22) Filed: Apr. 17, 2023

(51) Int. Cl.
*F41B 11/62* (2013.01)
*F41B 11/723* (2013.01)
*F41B 11/73* (2013.01)

(52) U.S. Cl.
CPC ..... *F41B 11/62* (2013.01); *F41B 11/723* (2013.01); *F41B 11/73* (2013.01)

(58) Field of Classification Search
CPC ..... F41B 11/721; F41B 11/722; F41B 11/723; F41B 11/62; F41B 11/73
USPC ..... 124/1, 71, 74, 64, 65, 66, 69
See application file for complete search history.

(56) References Cited

U.S. PATENT DOCUMENTS

2002/0002785 A1 1/2002 Tippmann, Jr.
2011/0113539 A1* 5/2011 Appleton ..... F41B 11/73 2/463
2012/0180771 A1* 7/2012 Hall ..... F41B 11/50 124/53.5
2016/0123696 A1* 5/2016 Lai ..... F41B 11/62 124/75

* cited by examiner

*Primary Examiner* — John Cooper
(74) *Attorney, Agent, or Firm* — MUNCY, GEISSLER, OLDS & LOWE, P.C.

(57) ABSTRACT

A concealed intake structure of a paintball gun includes a gun body, a trigger guard and a handgrip. A connector is connected with a bottom section of the handgrip and mated with a gas tank storing high-pressure compressed gas therein. A first gas passage is formed in the gun body, whereby high-pressure compressed gas can enter the first gas passage to fire paintballs. A passage is defined in the trigger guard in communication with the gun body and the handgrip. A gas line is disposed in the passage. Two locking heads are respectively disposed at two ends of the gas line. One of the locking heads is securely locked with the gun body in communication with the first gas passage. The other locking head is securely locked with the connector in communication with a second gas passage of the connector.

4 Claims, 4 Drawing Sheets

CONCEALED INTAKE STRUCTURE OF A PAINTBALL GUN

BACKGROUND OF THE INVENTION

1. Field of the Invention

The present invention relates generally to a paintball gun, and more particularly to a concealed intake structure of a paintball gun.

2. Description of the Related Art

U.S. Patent No. 20160123696 and U.S. Patent No. 20020002785 disclose conventional paintball guns. As disclosed in the above patents, in a paintball sport, a user of the paintball gun often needs to transpose the paintball gun held in the hand so as to move the paintball or aim the paintball at a target. The paintball has a gun body and a handgrip. A gas line is disposed between the gun body and the handgrip. In the paintball sport, the gas line of the conventional paintball gun is exposed to outer side. As a result, when a user transposes the paintball gun held in the hand, the user often incautiously collides with the gas line. This not only will affect the smoothness in the paintball sport process, but also may cause deformation of the gas line to deteriorate the appearance of the paintball gun due to the collision. In some more serious cases, the gas line may even be broken to make the paintball gun no longer useable. Under such circumstance, it is necessary to service the paintball gun.

Moreover, one end of the gas line is passed through the handgrip to connect with a connector in communication with a gas tank. The connector connected with the gas tank is locked under a bottom section of the handgrip by means of multiple screws. Therefore, when servicing or replacing the gas line, it is necessary to first remove the multiple screws from the connector so as to separate the connector from the handgrip and then the gas line can be separated from the connector. Accordingly, the complicatedness in assembling/disassembling of the gas line is increased and it is inconvenient to replace the gas line.

SUMMARY OF THE INVENTION

It is therefore a primary object of the present invention to provide a concealed intake structure of a paintball gun. The intake structure includes a gas line, which is enclosed in a trigger guard without being exposed to outer side. Accordingly, the gas line is protected from damage due to external force.

It is a further object of the present invention to provide the above concealed intake structure of the paintball gun, in which a locking head is disposed at one end of the gas line. The locking head is passed through a handgrip and locked on a connector. Accordingly, the connector can be directly connected with the locking head by means of screwing and securely connected with the handgrip without using any additional component. Therefore, the concealed intake structure of the paintball gun of the present invention has the effect that the assembling/disassembling process can be conveniently performed.

To achieve the above and other objects, the concealed intake structure of the paintball gun of the present invention includes a gun body, a handgrip, a trigger guard and a gas line. The handgrip, the trigger guard and the gas line are disposed under a bottom section of the gun body. The gun body has a gun barrel and an action assembly. A first gas passage is formed in the gun body, whereby high-pressure compressed gas can enter the first gas passage for the action assembly to fire paintballs. A connector is disposed under a bottom section of the handgrip and mated with a gas tank for storing the high-pressure compressed gas therein. The trigger guard is disposed between the handgrip and the gun body. A trigger assembly is disposed between the trigger guard and the handgrip for controlling the high-pressure compressed gas to enter the first gas passage. The concealed intake structure is characterized in that a passage is defined in the trigger guard in communication with an interior of the gun body and an interior of the handgrip. The gas line is disposed in the passage. Two locking heads are respectively disposed at two ends of the gas line. One of the locking heads is securely locked with the gun body so as to communicate the gas line with the first gas passage. The other of the locking heads is passed through the handgrip and securely locked with the connector so as to communicate the gas line with a second gas passage of the connector, whereby the high-pressure compressed gas can be supplied from the second gas passage through the gas line to the first gas passage.

Preferably, each of the locking heads is in the form of a hollow tube having a plug section and an outer thread section. The plug section is plugged in the gas line. The outer thread section is screwed with the gun body or the connector. When the plug section of the locking head is plugged into the gas line, a fastening sleeve is fitted around the gas line to hold the gas line and the plug section, whereby the locking head is secured to the gas line.

Preferably, the trigger guard is composed of an upper case and a lower case. The upper and lower cases are assembled and connected with each other by means of a locking assembly. Two assembling sections are respectively disposed at two ends of the lower case for correspondingly engaging with the upper case and the handgrip respectively.

Preferably, a regulation member is disposed on the connector. The regulation member has a stem section butting to the gas tank for regulating gas discharge amount thereof.

The present invention can be best understood through the following description and accompanying drawings, wherein:

DETAILED DESCRIPTION OF THE PREFERRED EMBODIMENTS

Figure 1:
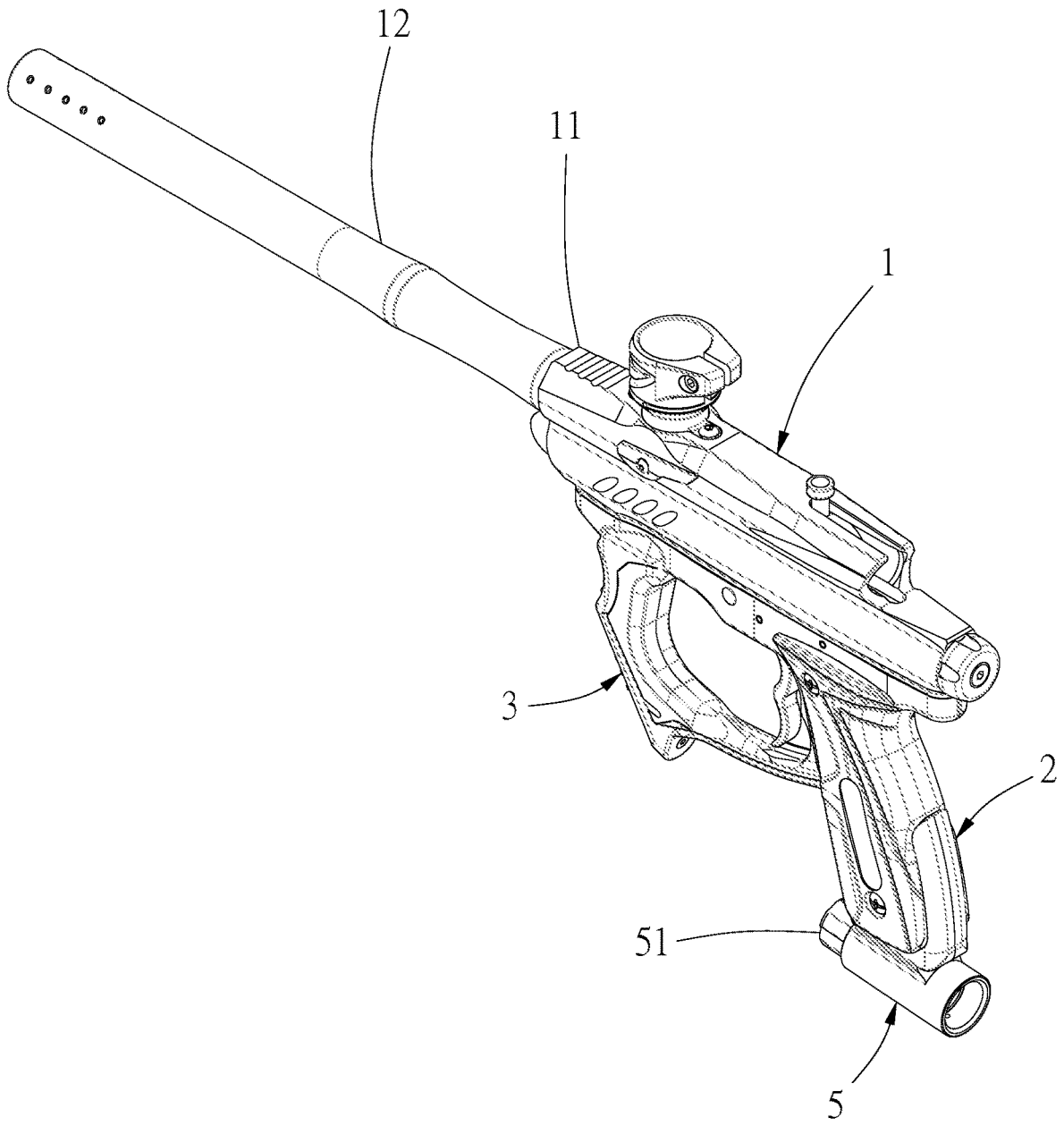
FIG. 1 is a perspective view of the present invention.
Figure 2:
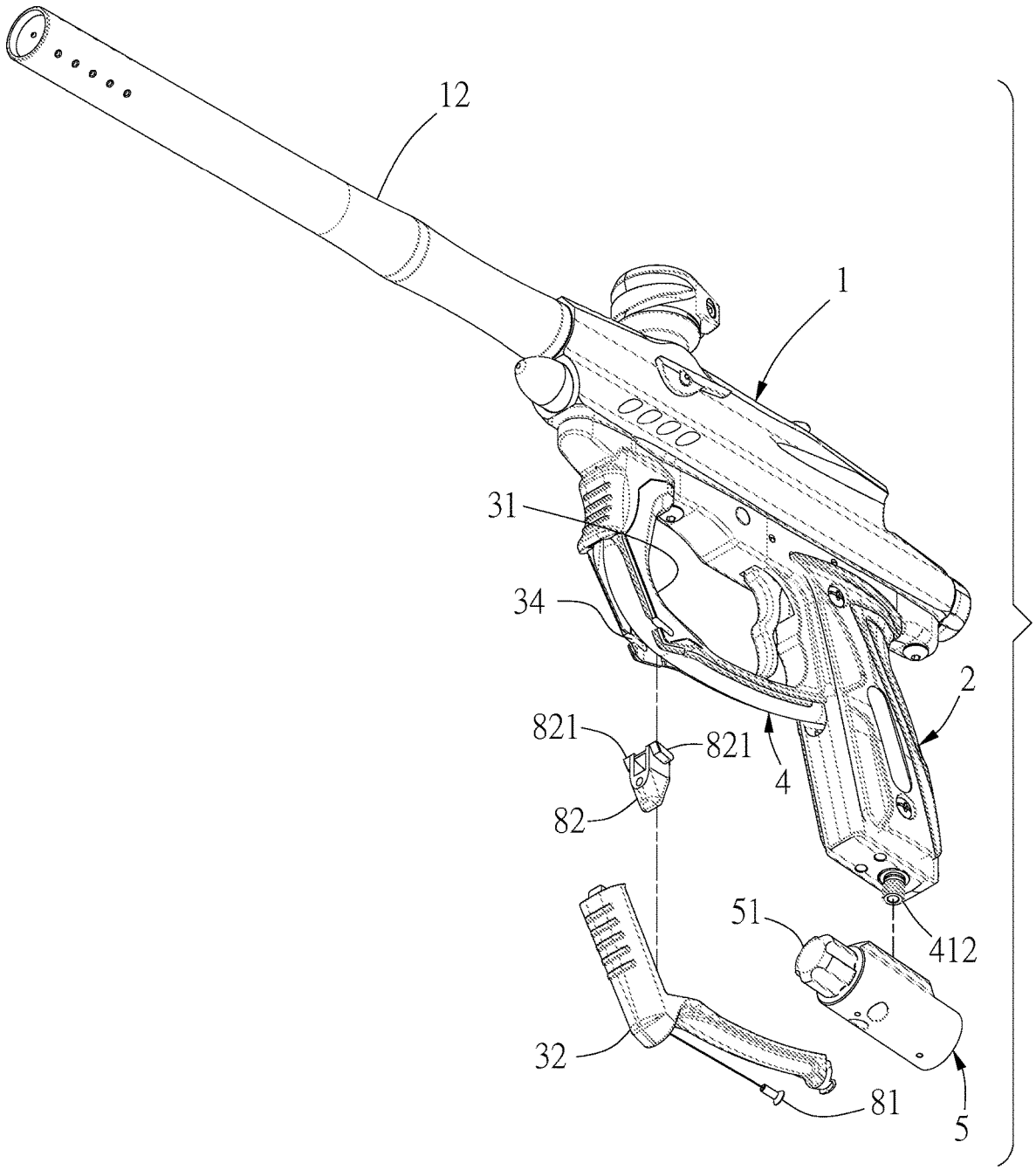
FIG. 2 is a perspective partially exploded view of the present invention.
Figure 3:
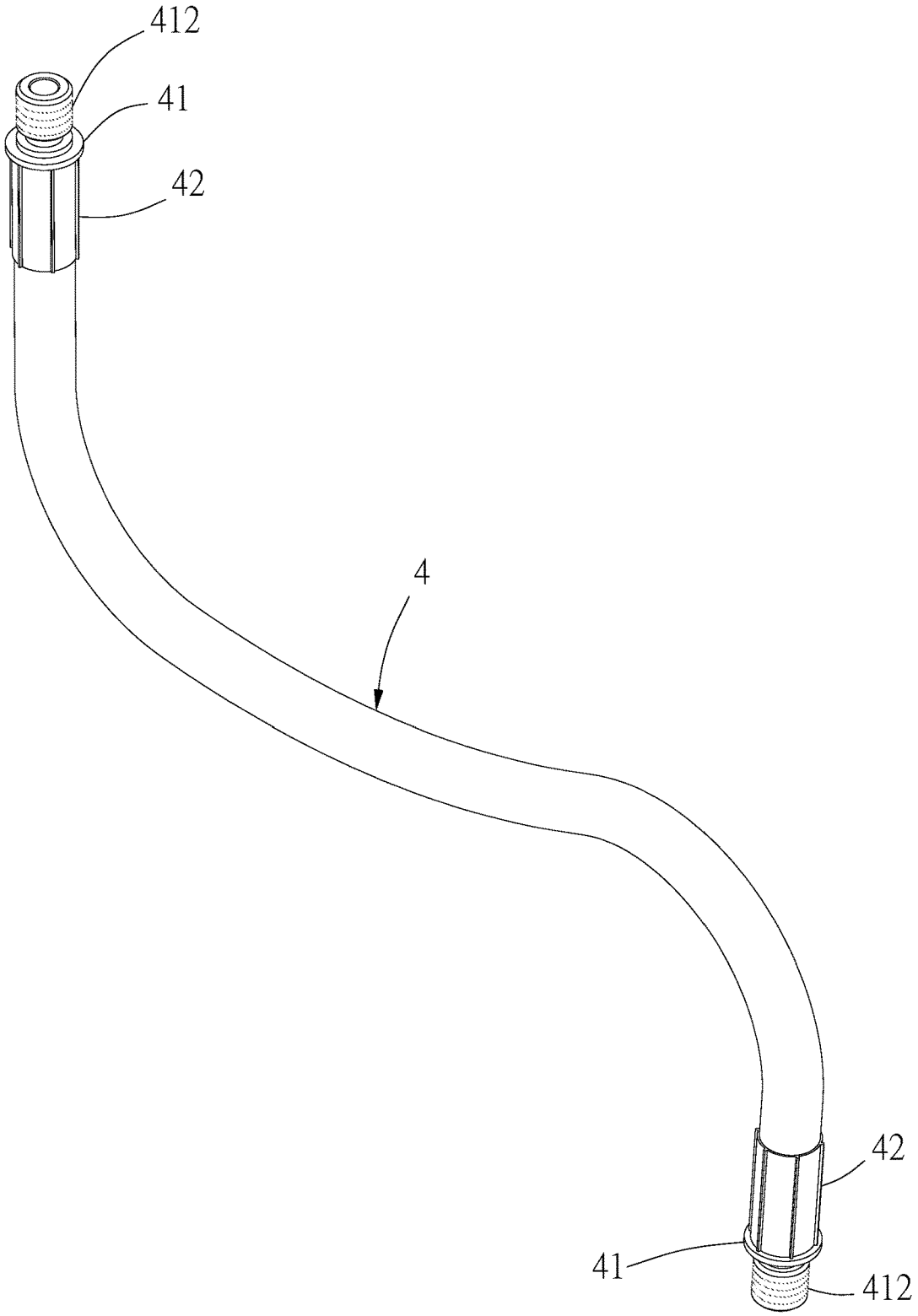
FIG. 3 is a perspective view of the gas line of the present invention.

Please refer to FIGS. 1 to 4, which show a concealed intake structure of a paintball gun of the present invention. The paintball gun of the present invention has a gun body 1, a handgrip 2, a trigger guard 3 and a gas line 4. The handgrip 2, the trigger guard 3 and the gas line 4 are all disposed under a bottom section of the gun body 1.

The gun body 1 has a front end 11 directed forward. A gun barrel 12 is disposed at the front end 11 of the gun body 1. In addition, an action assembly 13 is arranged inside the gun body 1. A first gas passage 14 is formed in the gun body 1, whereby high-pressure compressed gas can enter the first gas passage 14 for the action assembly 13 to fire paintballs.

A connector 5 is disposed under a bottom section of the handgrip 2 and mated with a gas tank 6 for storing the high-pressure compressed gas therein. A regulation member 51 is disposed on the connector 5. The regulation member 51 has a stem section 511 butting to the gas tank 6 for regulating gas discharge amount thereof.

The trigger guard 3 has an arced configuration. One end of the trigger guard 3 is connected with the gun body 1, while the other end of the trigger guard 3 is connected with the handgrip 2. The trigger guard 3 is positioned between the handgrip 2 and the gun body 1 and composed of an upper case 31 and a lower case 32. The upper and lower cases 31, 32 are mated with each other to define a passage 33 in communication with an interior of the gun body 1 and an interior of the handgrip 2. The upper and lower cases 31, 32 are assembled and connected with each other by means of a locking assembly. A trigger assembly 7 is disposed between the trigger guard 3 and the handgrip 2 for controlling the high-pressure compressed gas to enter the first gas passage 14. In this embodiment, the upper case 31 can be integrally formed with the handgrip 2 by injection molding and locked with the gun body 1 by means of two screws.

The locking assembly is composed of a screw 81 and a connection member 82. Two protruding blocks 821 are respectively formed on two opposite sides of the connection member 82. Two sinks 34 are respectively formed on two opposite inner sides of the upper case 31. The protruding blocks 821 are respectively inserted in the sinks 34 of the upper case 31. Moreover, the screw 81 is passed through the lower case 32 and screwed with the connection member 82 so as to secure the lower case 32 to the upper case 31.

In addition, two assembling sections are respectively disposed at two ends of the lower case 32 for correspondingly engaging with the upper case 31 and the handgrip 2 respectively. The assembling section for engaging with the upper case 31 has the form of a boss, while the assembling section for engaging with the handgrip 2 has the form of a hook. Accordingly, three fixed sections (two ends and the middle section) of the lower case 32 are securely connected with the upper case 31 and the handgrip 2, whereby the connection strength between the upper and lower cases 31, 32 and the handgrip 2 is enhanced.

The gas line 4 is made of plastic material and positioned in and through the passage 33. Two locking heads 41 are respectively disposed at two ends of the gas line 4. One of the locking heads 41 is passed through the upper case 31 and securely locked with the gun body 1 so as to communicate the gas line 4 with the first gas passage 41. The other of the locking heads 41 is passed through the handgrip 2 and securely locked with the connector 5 so as to communicate the gas line 4 with a second gas passage 52 of the connector 5. Accordingly, the high-pressure compressed gas can be supplied from the second gas passage 52 through the gas line 4 to the first gas passage 14.

Each of the locking heads 41 is in the form of a hollow tube having a plug section 411 and an outer thread section 412. The plug sections 411 are respectively plugged into two ends of the gas line 4. The outer thread sections 412 are respectively screwed with the gun body 1 and the connector 5. When the plug section 411 of each of the locking heads 41 is plugged into one end of the gas line 4, a metal-made fastening sleeve 42 is fitted around the end of the gas line 4 to hold the end of the gas line 4 and the plug section 411, whereby the locking head 41 is secured to the gas line 4.

Figure 4:
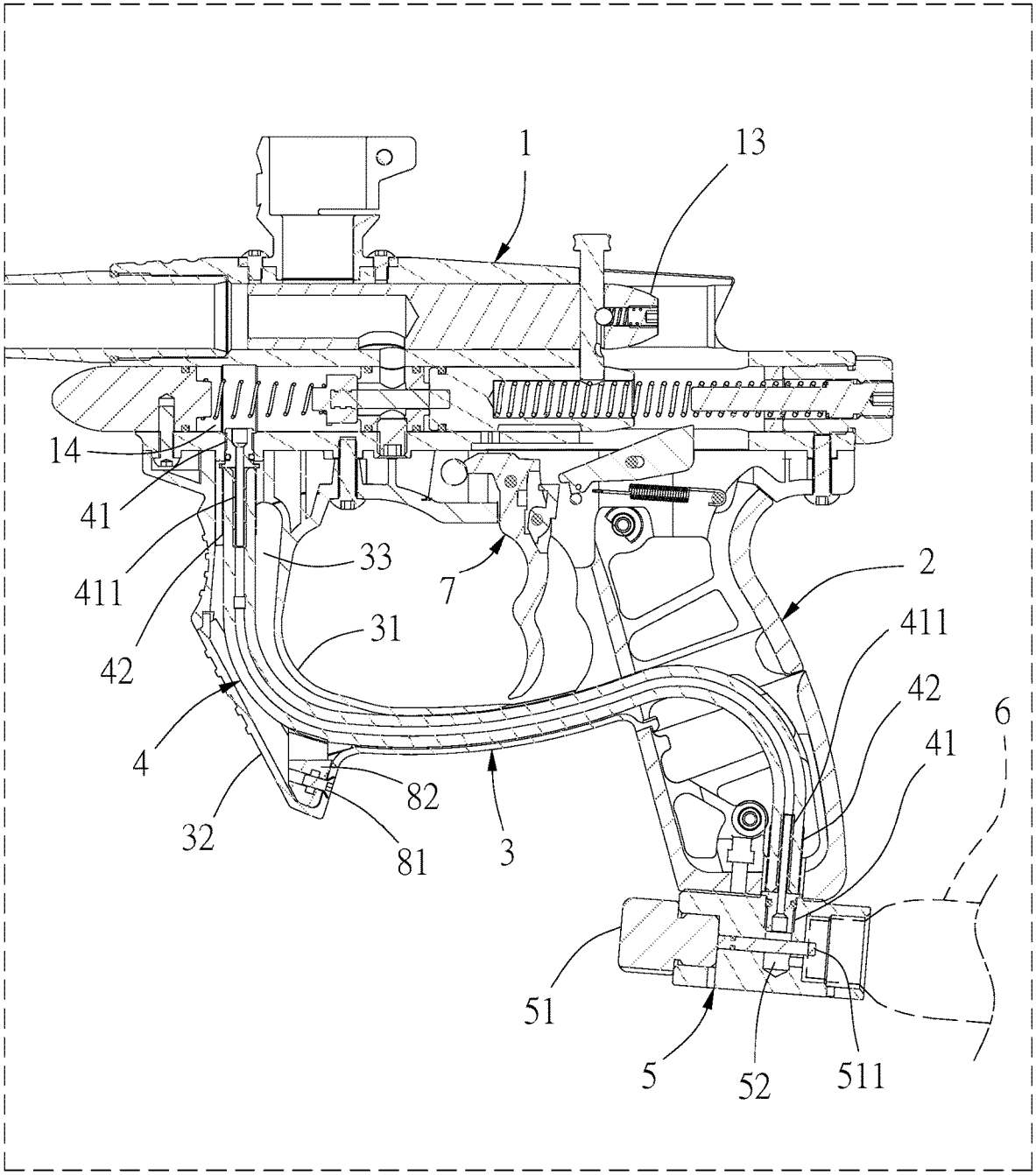
FIG. 4 is a partially sectional view of the present invention.

In addition, with reference to FIG. 4, in the case that the connector 5 is connected with the gas tank 6, by means of rotating the regulation member 51, the stem section 511 is driven to displace. When the regulation member 51 is rotated into the connector 5, the stem section 511 pushes in a valve pin of the gas tank 6, whereby the high-pressure compressed gas in the gas tank 6 is discharged to go through the second gas passage 52 into the gas line 4. When the regulation member 51 is rotated outward from the connector 5, the stem section 511 is moved outward along with the regulation member 51. At this time, the valve pin of the gas tank 6 bounds out, whereby the high-pressure compressed gas is hindered from further going through the second gas passage 52 into the gas line 4.

The concealed intake structure of the paintball gun of the present invention has the following advantages:

1. The gas line 4 of the present invention is positioned in and through the passage 33 of the trigger guard 3 and fully enclosed therein. Therefore, the gas line 4 is not exposed to outer side as the conventional gas line of the paintball gun. In this case, the gas line 4 is prevented from being pulled by an incautious user of the paintball gun in the energetic paintball sport. Accordingly, the gas line 4 is protected from damage due to external force.
2. The gas line 4 of the present invention is directly securely locked with the connector 5 via the locking head 41 by means of screwing. Therefore, the connector 5 can be securely connected with the handgrip 2 without using any additional component. Also, the connector 5 can be quickly detached from the locking head 41 and thus separated from the handgrip 2 simply by means of unscrewing the connector 5. Therefore, the assembling/disassembling process can be quickly and conveniently performed.
3. The gas line 4 of the present invention is connected with the gun body 1 and the handgrip 2 via the locking heads 41 by means of screwing. In addition, the trigger guard 3 is designed with a detachable structure. Therefore, when it is necessary to replace the gas line 4, a user only needs to disassemble the trigger guard 3 and unscrewing the locking heads 4 from the gun body 1 and the handgrip 2 for detaching the gas line 4. Accordingly, the service and replacement of the gas line 4 can be more easily performed.

The above embodiments are only used to illustrate the present invention, not intended to limit the scope thereof. Many modifications of the above embodiments can be made without departing from the spirit of the present invention.

What is claimed is:

1. A concealed intake structure of a paintball gun comprising a gun body, a handgrip, a trigger guard and a gas line, the handgrip, the trigger guard and the gas line being disposed under a bottom section of the gun body, the gun body having a gun barrel and an action assembly, a first gas passage being formed in the gun body, whereby high-pressure compressed gas can enter the first gas passage for the action assembly to fire paintballs, a connector being disposed under a bottom section of the handgrip and mated with a gas tank for storing the high-pressure compressed gas therein, the trigger guard being disposed between the handgrip and the gun body, a trigger assembly being disposed between the trigger guard and the handgrip for controlling the high-pressure compressed gas to enter the first gas passage, the concealed intake structure being characterized in that a passage is defined in the trigger guard in communication with an interior of the gun body and an interior of the handgrip, the gas line being disposed in the passage, two locking heads being respectively disposed at two ends of the gas line, one of the locking heads being securely locked with the gun body so as to communicate the gas line with the first gas passage, the other of the locking heads being passed through the handgrip and securely locked with the connector so as to communicate the gas line with a second gas passage of the connector, whereby the high-pressure compressed gas can be supplied from the second gas passage through the gas line to the first gas passage.

2. The concealed intake structure of the paintball gun as claimed in claim 1, wherein each of the locking heads is in the form of a hollow tube having a plug section and an outer thread section, the plug section being plugged in the gas line, the outer thread section being screwed with the gun body or the connector, when the plug section of the locking head is plugged into the gas line, a fastening sleeve being fitted around the gas line to hold the gas line and the plug section, whereby the locking head is secured to the gas line.

3. The concealed intake structure of the paintball gun as claimed in claim 1, wherein the trigger guard is composed of an upper case and a lower case, the upper and lower cases being assembled and connected with each other by means of a locking assembly, two assembling sections being respectively disposed at two ends of the lower case for correspondingly engaging with the upper case and the handgrip respectively.

4. The concealed intake structure of the paintball gun as claimed in claim 1, wherein a regulation member is disposed on the connector, the regulation member having a stem section butting to the gas tank for regulating gas discharge amount thereof.

* * * * *